US005713801A

United States Patent [19]

Aoyama

[11] Patent Number: 5,713,801

[45] Date of Patent: Feb. 3, 1998

[54] GOLF BALL WITH WOUND HOOP-STRESS LAYER

[75] Inventor: Steven Aoyama, Marion, Ill.

[73] Assignee: Acushnet Company, Fairhaven, Mass.

[21] Appl. No.: 484,243

[22] Filed: Jun. 7, 1995

[51] Int. Cl.[6] ..... A63B 37/04; A63B 37/06; A63B 37/08

[52] U.S. Cl. ..... 473/354; 473/360; 473/362; 473/365

[58] Field of Search ..... 473/360, 356, 473/357, 358, 359, 361, 362, 363, 364, 365, 354

[56] References Cited

U.S. PATENT DOCUMENTS 711,177 10/1902 Richards ..... 473/360

*Primary Examiner*—George J. Marlo

*Attorney, Agent, or Firm*—Pennie & Edmonds LLP

[57] ABSTRACT

The invention relates to a golf ball having a substantially spherical inner core, a layer of high tensile elastic modulus fibers wound about the inner core, and a molded layer of a polymeric material surrounding the wound layer. The high tensile elastic modulus fibers have a tensile elastic modulus of at least 10,000 kpsi. The invention also relates to a method of making a golf ball and includes providing an inner core, winding a high tensile elastic modulus fiber on the inner core to create a wound layer, and molding an outer layer of polymeric material about the wound layer. The inner core may be made of resilient materials or a center wound with a low modulus fiber and provided with an initial tension.

20 Claims, 1 Drawing Sheet

FIG. 1
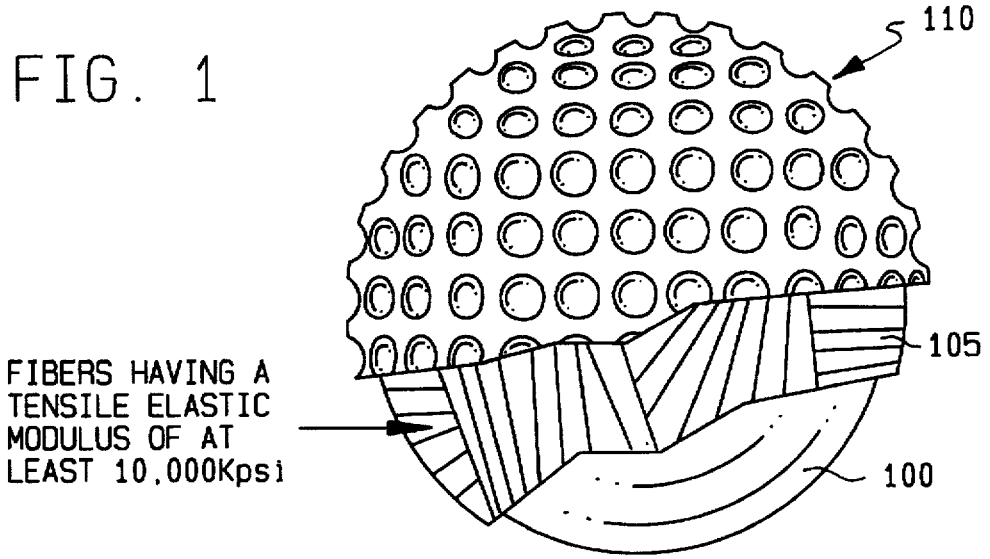
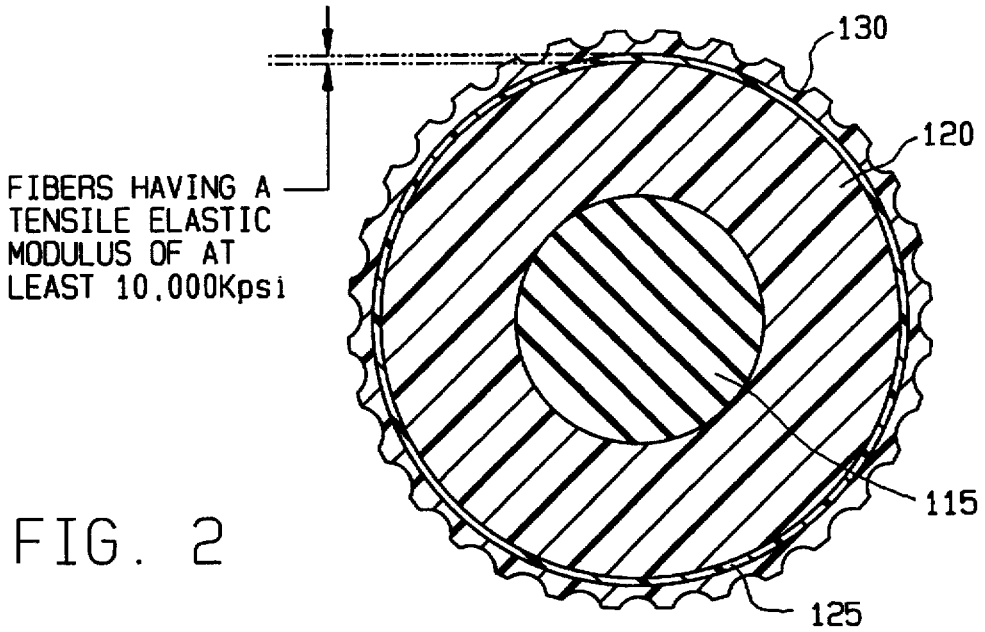
FIG. 2
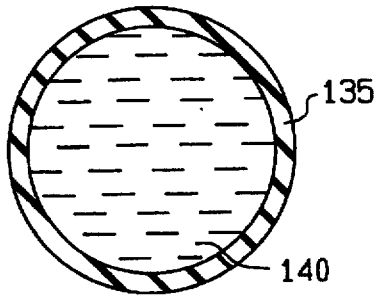
FIG. 3

GOLF BALL WITH WOUND HOOP-STRESS LAYER

FIELD OF THE INVENTION

This invention is directed to a golf ball having a thin wound hoop-stress layer. In particular it is directed to a golf ball having an inner resilient core, a layer wound of high-modulus fibers and an outer cover layer.

PRIOR ART

In the past, the cover of a golf ball has been relied upon to provide a confining hoop stress function which is believed to increase the initial velocity of a golf ball when struck by a golf club. For balls having a wound core, typically a solid or liquid filled center wound with a rubber thread, this hoop stress function of the cover has been only of moderate importance, since the wound core can be made lively enough on its own without requiring a cover providing significant hoop stress about the core. On the other hand, golf balls with solid cores tend to have a marginal velocity on their own, and are benefitted by a layer providing additional hoop stress. To date, this stress has been provided by a cover made of a relatively stiff material.

The drawbacks of these ball constructions are numerous. The elastic thread of wound balls must be wound under high tension in order to produce a ball that will achieve the necessary velocity. Often, this causes the thread to break during winding or later manufacturing processes. Reduced thread tension during winding would minimize this problem, but would also cause a loss of velocity and compression which would then necessitate the use of a relatively hard and stiff cover that would provide the necessary hoop stress. This cover would give the ball an unacceptably harsh feel, negating a primary attribute of the wound ball. Solid construction balls have a slightly different problem. Since the cover layer must provide significant hoop stress, it is usually hard and stiff as a result. This problem is magnified when the core is made of a relatively soft compound in an attempt to give the ball a softer feel when struck.

One technique suggested in the prior art to avoid the problem of an overly hard stiff cover was disclosed in U.S. Pat. No. 4,431,193 issued to Nesbitt on Feb. 14, 1984. Rather than have a single layer cover over the cored the cover would be molded in two layers: a hard stiff inner layer of a high flexural modulus material that provides significant hoop stress, surrounded by a soft, flexible outer cover of a lower flexural modulus material. This design is at best a compromise. In order to provide the hoop stress necessary, a high flexural modulus inner layer is used that, because of its thickness (0.02–0.07 inches) and its high flexural modulus (51 kpsi), still provides a too-stiff feel to the golfer.

The present invention takes a different approach, that of providing an additional wound rather than solid layer to provide the necessary hoop stress. This layer is wound of a high tensile elastic modulus material such as aromatic polyamide fibers (for example aramid fibers sold by E.I. dupont De Nemours Co., Wilmington, Del., under the trademark of "Kevlar"), glass fiber, or metal wire. This wound high tensile elastic modulus layer under the cover gives a soft and flexible construction element that serves to provide the hoop stress while contributing minimally to the hardness of feel. By providing this wound layer, the cover material may be chosen for spin, feel and durability alone, without adding structural requirements as well.

The invention has a further benefit for golfers with a low swing speed. A low swing speed does not sufficiently compress the golf ball at impact, and thus does not generate high enough internal stresses in the ball to achieve the explosive rebound off the club face which is enjoyed by those with higher swing speeds. The contact time between the ball and club face is longer and the golfer does not get the same crisp feel. A high modulus hoop stress layer will produce higher internal stresses at low swing speeds, giving these players enhanced rebound and feel. A further advantage to the invention is that the moment of inertia of the ball, and thus its spin characteristics, can be controlled by choosing the mass density and thickness of the hoop stress layer. For example, a very high moment of inertia could be created by using metallic wire in the wound hoop stress layer. The result would be a ball with a relatively low initial spin rate and low spin decay rate during flight. These and other advantages of the invention will be discussed below.

SUMMARY OF THE INVENTION

The invention includes a golf ball having a substantially spherical inner core, a first wound layer of high tensile elastic modulus fibers wound about the inner core, and a second molded layer of a polymeric material surrounding the wound layer. The invention also includes a method of making a golf ball, including providing an inner core, winding a high elastic modulus fiber on the inner core to create a first wound layer, and molding an outer layer of polymeric material about the first wound layer. The inner core in the above method and apparatus may be made of solid resilient materials or a center wound with a low modulus fiber under an initial tension.

BRIEF DESCRIPTION OF THE DRAWINGS

FIG. 1 illustrates a cut-away view of a solid inner core golf ball in accordance with the current invention;

FIG. 2 illustrates a cross-section of a wound inner core golf ball in accordance with the present invention; and FIG. 3 illustrates a hollow golf ball center for a golf ball in accordance with the present invention.

DETAILED DESCRIPTION

In FIG. 1, a substantially spherical inner core 100 has a wound layer 105 of high tensile elastic modulus material wound about it. This wound layer has a cover layer 110 of polymeric material molded about and surrounding it.

The inner core is solid and formed of a resilient material, preferably a polybutadiene or natural rubber containing compound.

The wound layer is formed of high tensile fiber wound about the inner core and preferably in contact with the inner core. A variety of high tensile modulus fibers may provide the requisite hoop stress in a minimally thick layer, preferably glass, Dacron, polyamide, aromatic polyamide (such as duPont's Kevlar aramid fiber), carbon, or metal fibers. Metals such as steel (particularly stainless steel), monel metal, or titanium are preferred. If a wound layer is created from metal fiber, the ball will have an increased moment of inertia, and thus will rotate at a slower speed when struck with a golf club, and will retain its rotational velocity longer during flight.

The strength of these high tensile elastic modulus fibers is preferably high to accommodate the extremely high stresses placed upon the golf ball windings when it is struck with a golf club. It can be varied, however, to provide a golf ball with a good feel and durability. A tensile strength of at least 250 kpsi is preferred, however a tensile strength of at least 500 kpsi is more preferred.

The tensile elastic modulus of the high tensile elastic modulus fiber along with its gauge or thickness may also be varied to provide a stiffer, a softer or a more durable ball as desired. A modulus of at least 10000 kpsi is preferred. A modulus of at least 20000 kpsi is most preferred.

In the preferred embodiment, a single fiber is wound about the inner core to create the wound layer. The fiber is preferably a continuous fiber to provide for ease of winding. The fiber material is preferably in yarn, thread or filament form.

The wound layer 105 preferably has an outside diameter of between 1.40 and 1.81 inches, and an inside diameter of between 1.30 and 1.80 inches. The wound layer is preferably wound to a thickness of between 0.01 and 0.10 inches.

The cover layer 110 preferably has an outside diameter of between 1.68 and 1.85 inches. More preferably, it has an outside diameter of between 1.68 and 1.72 inches. Its thickness is preferably between 0.04 and 0.14 inches. The preferred cover materials are an ionomer (such as the variety of ionomers sold by the DuPont Chemical Company under the trade name of "Surlyn"), or balata, a naturally occurring substance or its synthetic equivalent. This layer is preferably in direct contact with the wound layer. The combined thickness of the wound layer and the cover layer is preferably between 0.05 and 0.24 inches.

Another embodiment is shown in FIG. 2 for a golf ball with a wound inner core. In this embodiments the inner core of the golf ball is made of a resilient center 115 with a layer 120 of low tensile elastic modulus material wound about it. Layer 120 has a wound layer 125 of high tensile elastic modulus fiber surrounding it. A cover layer 130 is molded about and surrounds wound layer 125.

The resilient center 115 is preferably a solid and preferably made of polybutadiene, however, FIG. 3 shows an alternative embodiment of center 115: a hollow center 135 made of natural rubber that is filled with a suitable liquid or paste-like material 140.

Referring back to FIG. 2, layer 120 surrounding the center may be solid or wound of an elastic material. If wound, it preferably has a tensile elastic modulus less than 5000 psi. If layer 120 is wound, an initial strain of at least 100% is preferred. Layer 120 and high elastic modulus layer 125 are preferably in contact, as are layers 125 and 130.

Wound layer 125 has the characteristics described above regarding the wound layer of FIG. 1. The high tensile elastic modulus fiber that comprises layer 125 should be wound about the core with an initial tension applied to the fiber during the winding process which provides an initial strain on the fiber being wound. An initial strain of less than 4% is most preferred. An initial strain of less than 10% is more preferred. An initial strain of less than 25% is preferred. The fiber itself is continuous for ease of winding about the core.

Once the wound layer is created, a cover layer is molded about the wound layer, preferably by injection or compression molding processes well known to those of ordinary skill in the art of manufacturing golf balls.

I claim:

1. A golf ball comprising:

a substantially spherical inner core;

a wound layer of fiber having a tensile elastic modulus of at least 10,000 kpsi wound about said core; and a molded layer of a polymeric material surrounding said wound layer.

2. The golf ball of claim 1, wherein said wound layer has an inside diameter of between 1.30 and 1.80 inches.

3. The golf ball of claim 2, wherein said wound layer has a thickness of between 0.01 and 0.10 inches.

4. The golf ball of claim 3, wherein said molded layer is the cover and has a thickness of between 0.04 and 0.14 inches.

5. The golf ball of claim 4, wherein said fiber is made of a material selected from the group consisting of glass, aromatic polyamide, carbon or metal.

6. The golf ball of claim 1, wherein said fiber has a tensile elastic modulus of at least 20000 kpsi.

7. The golf ball of claim 6, wherein said fiber is a continuous fiber.

8. The golf ball of claim 1, wherein said core is comprised of a resilient center and a second wound layer of a low tensile elastic modulus material wound about said resilient center.

9. The golf ball of claim 8, wherein said low tensile elastic modulus material has a modulus of less than 2000 psi.

10. The golf ball of claim 1, wherein the fiber is non-metallic.

11. The golf ball of claim 10, wherein the fiber is selected from the group consisting of carbon, plastic, and glass.

12. The golf ball of claim 11, wherein the plastics include polyamide, aromatic polyamide, and aramid fibers.

13. The golf ball of claim 11, wherein the inner core is a hollow resilient center and is filled with a flowable material.

14. The golf ball of claim 1, wherein the fiber is selected from the group consisting of monel, titanium, carbon, and inorganic material.

15. The golf ball of claim 14, wherein the inorganic material includes plastic, glass, or non-metallic material.

16. The golf ball of claim 1, wherein the inner core is a solid resilient center.

17. The golf ball of claim 1, wherein said fiber has a tensile strength of at least 250 kpsi.

18. A method of making a golf ball, comprising the steps of:

providing an inner core;

winding a high elastic modulus fiber having a tensile elastic modulus of at least 10,000 kpsi on said core to create a wound layer; and molding an outer layer of polymeric material about said wound layer.

19. The method of claim 18, further comprising a step of tensioning said high elastic modulus fiber as said fiber is wound on said core to provide said fiber with an initial strain of less than about 25%.

20. The method of claim 18, wherein the step of providing an inner core includes:

providing a golf ball center;

tensioning a low tensile elastic modulus fiber having a tensile elastic modulus of less than 5000 psi to have an initial strain of at least 100%; and winding said low tensile elastic modulus fiber on said center to create a golf ball inner core.

* * * * *

UNITED STATES PATENT AND TRADEMARK OFFICE

CERTIFICATE OF CORRECTION

PATENT NO. : 5,713,801

DATED : February 3, 1998

INVENTOR(S) : Aoyama

It is certified that error appears in the above-identified patent and that said Letters Patent is hereby corrected as shown below:

[75] Inventor: change "Marion, Ill." to --Marion, Mass.--.

Signed and Sealed this

Eighth Day of September, 1998

*Attest:*

BRUCE LEHMAN

*Attesting Officer*

*Commissioner of Patents and Trademarks*